United States Patent [19]

Houston

[11] 4,023,550

[45] May 17, 1977

[54] ENGINE WITH OVERSPEED PREVENTION

[75] Inventor: George F. Houston, Milwaukee, Wis.

[73] Assignee: Briggs & Stratton Corporation, Wauwatosa, Wis.

[22] Filed: Nov. 17, 1975

[21] Appl. No.: 632,780

Related U.S. Application Data

[63] Continuation-in-part of Ser. No. 500,862, Aug. 27, 1974, abandoned.

[52] U.S. Cl. ..... 123/198 D; 56/10.2; 123/97 R; 123/108

[51] Int. Cl.[2] ..... F02B 77/00; F02D 31/00

[58] Field of Search ... 123/198 D, 198 DB, 198 DC, 123/103 C, 103 D, 108, 97 R, 198 R; 56/10.2, 12.8

[56] References Cited

UNITED STATES PATENTS

| | | | |
|---|---|---|---|
| 2,382,952 | 8/1945 | Armstrong | 123/108 |
| 2,529,243 | 11/1950 | Brown et al. | 123/108 |
| 3,019,596 | 2/1962 | Henninger | 123/198 D X |
| 3,104,657 | 9/1963 | Rice | 123/108 X |
| 3,199,530 | 8/1965 | Svendsen | 123/103 D |
| 3,323,504 | 6/1967 | Jacobi | 123/108 X |
| 3,433,209 | 3/1969 | Freitag | 123/198 R |
| 3,905,348 | 9/1975 | William, Jr. | 123/198 D |

*Primary Examiner*—C. J. Husar
*Assistant Examiner*—Ira S. Lazarus
*Attorney, Agent, or Firm*—Ira Milton Jones & Associates

[57] ABSTRACT

An engine with an air vane type governor and provision for preventing overspeeding of the engine in the event the governor fails to do so, wherein a normally restrained or loaded spring acts to effect closing adjustment of the throttle valve upon release of its restraint by a tripping device actuated by a centrifugally projected plunger on the engine flywheel. In a modified embodiment, the release of the spring effects closure of an ignition grounding switch.

19 Claims, 10 Drawing Figures

46
45
47
46
48
13
42
30
31
49
37
29
4
4
22
15
19
25
21
43
27
32
33

45
47
48
46
13

49
31
37
19
44
42
45
21
25
43
15
27
22
32
33

Fig. 4
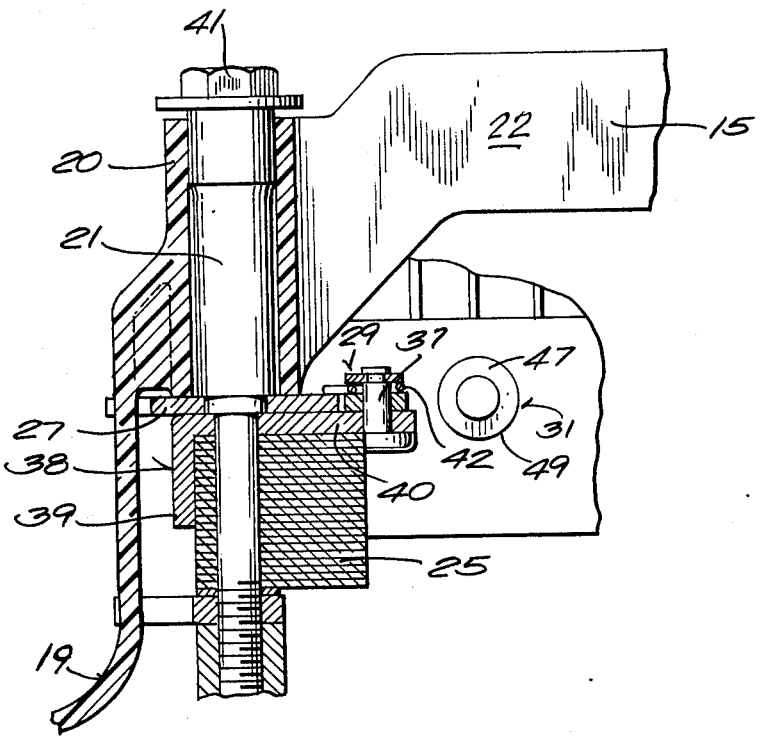
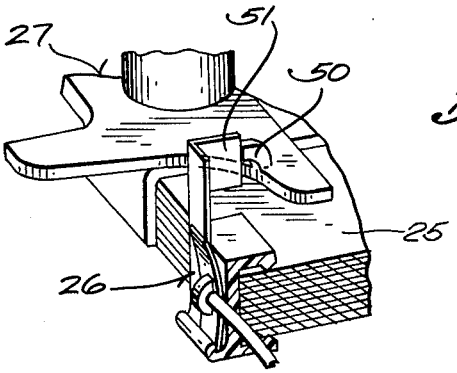
Fig. 5

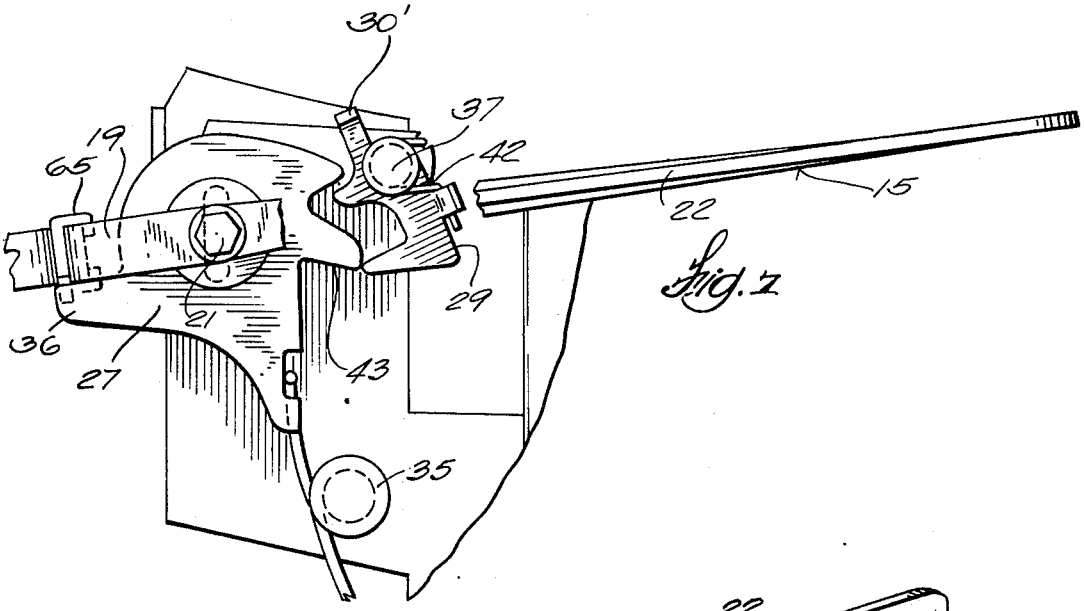
Fig. 7
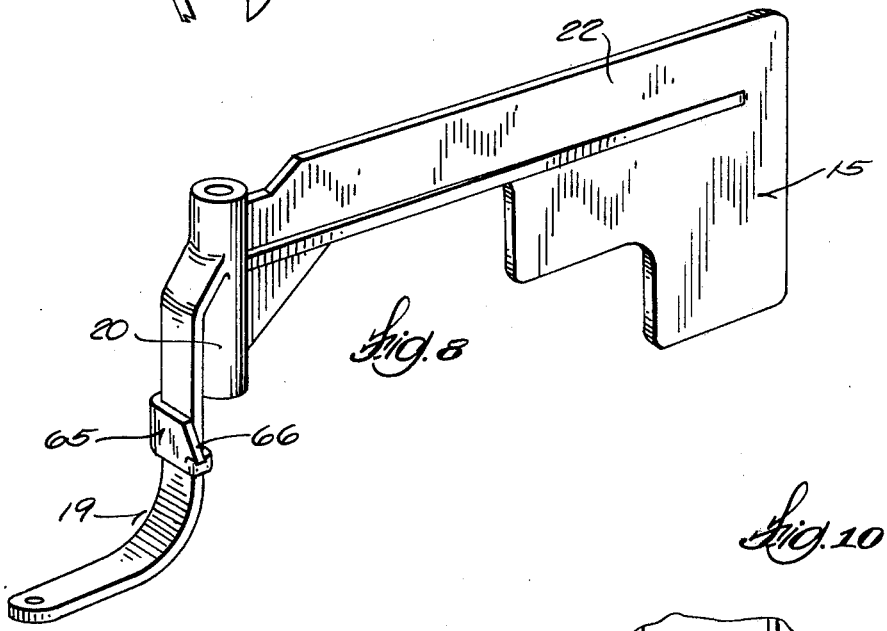
Fig. 8
Fig. 10
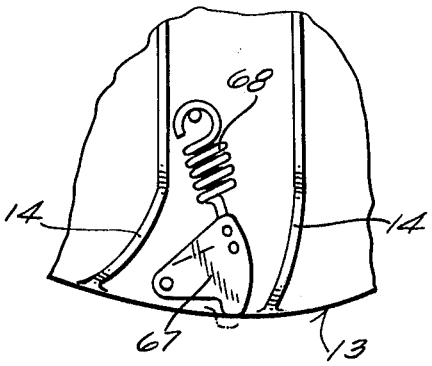
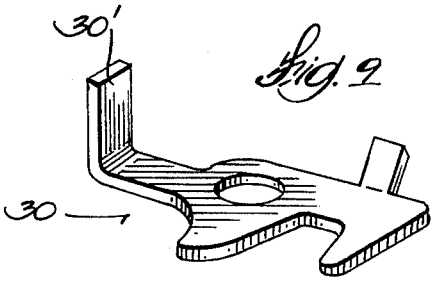
Fig. 9

ENGINE WITH OVERSPEED PREVENTION

This invention relates to engines, and—as in the copending allowed application Ser. No. 500,862, filed Aug. 27, 1974, now abandoned of which this application is a continuation in part—refers more particularly to single cylinder engines used to power lawn mowers, especially rotary lawn mowers.

The purpose and object of the invention is to provide a reliable engine speed control that will enable the engine manufacturer to guarantee his customers that under no circumstances will the engine speed exceed a predetermined maximum rate.

Engines of the type with which this invention is concerned have always been equipped with governors by which a selected speed is maintained fairly uniformly despite reasonable variations in load. These governors are either of the mechanical flyweight type or of the air vane variety, the latter being by far the more common because of its lower cost.

In an air vane governor, a spring—usually a coiled tension spring called the governor spring—is connected between the throttle valve and an adjustable speed selector lever to apply an opening force to the throttle valve. This opening force is opposed by air pressure derived from the engine cooling blower and applied to the throttle valve by a freely pivoted vane which is linked to the throttle valve and mounted to respond to the flow of cooling air through the blower housing or shroud.

Obviously, of course, the force which the pressure of air flowing through the blower housing exerts upon the vane, and hence upon the throttle valve, is proportional to engine speed since the blower or fan is driven by the engine, being usually formed on the engine flywheel. The speed at which the two opposing forces balance is the governed speed of the engine.

Theoretically—and even under normal conditions—an air vane type governor can be expected to prevent overspeeding of the engine, but only too often grass clippings and other debris clogs or partially clogs the blower housing, and when that happens the force of the air pressure on the air vane cannot balance the opening force which the governor spring exerts upon the throttle valve. As a result, the engine overspeeds. Overspeeding is always undesirable, but in the case of rotary lawn mowers, it is a very serious safety hazard.

A reliable top speed limiting device for engines used to drive rotary lawn mowers is therefore a very desirable and valuable asset, since it enables the engine manufacturer to meet the demands of his customers for assurances that the engines they buy from him will not overspeed under any circumstance.

This invention attains this objective through the provision of a normally restrained spring operable, when released, to unquestionably bring the engine throttle valve to an idling position, and centrifugally responsive actuating mechanism to release that spring. The actuator of that mechanism is a plunger that projects from the periphery of the flywheel when the speed of the engine exceeds a predetermined rate.

In the preferred embodiment of the invention, release of the restrained spring, as stated, moves the throttle valve to an idling position. Such reduction of engine speed, if repeated a few times, would be an indication that something was wrong with the governor and would lead the operator to the source of the trouble—usually an accumulation of grass clippings in the blower housing.

However, the release of the restrained or loaded spring can also be used to close an ignition grounding switch, as in the modified embodiment of the invention disclosed herein.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of the embodiment of the invention constructed according to the best mode so far devised for the practical application of the principles thereof, and modified embodiments of certain aspects of the invention and in which:

FIG. 4 is a vertical sectional view through FIG. 2 on the plane of the line 4—4;

FIG. 5 is a fragmentary detail view in perspective, illustrating a modified embodiment of the invention, wherein tripping of the overspeed protection mechanism closes an ignition grounding switch;

FIG. 7 is a fragmentary top view similar to FIGS. 2 and 3, illustrating the consequences of a sometimes encountered problem when the location of the magneto stator on the cylinder casting renders it impossible to reset the tripped mechanism by means of the air vane;

FIG. 8 is a perspective view of part of the air vane equipped with an adjustable cam by which the problem illustrated in FIG. 7 can be eliminated;

FIG. 9 is a perspective view of an improved latch by which the mechanism is held in its latched condition; and FIG. 10 is a fragmentary top view of a segment of the flywheel illustrating a modified form of centrifugally responsive latch tripping actuator.

Figure 1:
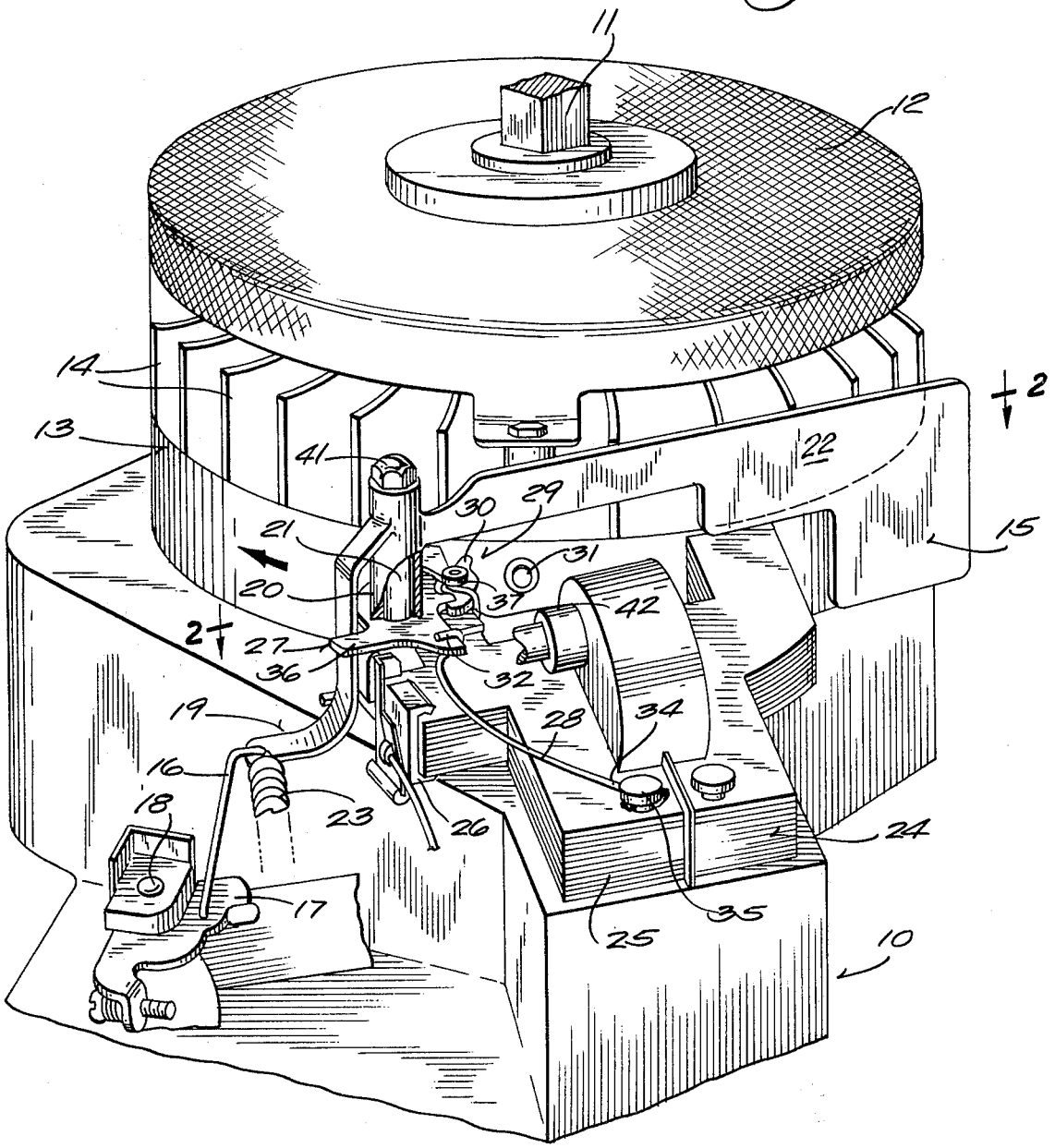
FIG. 1 is a perspective view of that portion of a conventional single cylinder vertical shaft engine needed to be shown to illustrate the adaptation of the invention thereto, the blower housing or shroud of the engine having been omitted for sake of clarity.

Referring to the accompanying drawings, the numeral 10 designates the crankcase of a single cylinder vertical shaft engine of the type widely used to power rotary lawn mowers. The engine has the customary crankshaft, to the bottom end of which the mower blade (not shown) is secured. Only the non-circular upper end portion 11 of the crankshaft is shown projecting upwardly from the screen 12 that is secured to the engine flywheel 13. Engine starting mechanism, not shown, connects with the non-circular upper end portion of the crankshaft.

The flywheel has the usual vanes 14 formed integrally therewith around its circumference to provide the blower or fan by which engine cooling air is drawn into a blower housing or shroud (not shown) to be directed thereby over the finned hot surfaces of the engine. The screen 12 extends across the inlet to the blower housing, and is intended to exclude grass clippings and other debris from the blower housing, but—only too often—the blower housing becomes clogged or partially clogged. When that happens, the efficiency of the cooling system suffers, but—more important—the air vane type governor, indicated generally by the numeral 15, with which most lawnmower engines are equipped, cannot prevent overspeeding of the engine.

In essence, the governor 15 is like that of the Brown et al U.S. Pat. No. 2,529,234, issued Nov. 7, 1950, to the assignee of this invention. Accordingly, the governor is connected with the throttle valve of the engine (not shown) by a link 16 which has one end connected with an arm 17 that is fixed to the shaft 18 of the throttle valve. The other end of the link 16 is attached to an arm 19 that extends from an elongated hub 20 mounted to rock about a fixed vertical pivot pin 21. The hub 20 also has an air vane 22 projecting from it into the path of the air flow induced by the blower to swing outwardly from the flywheel in response to the air pressure emanating from the blower.

Outward displacement of the air vane rocks the arm 17 in the direction to exert a closing force on the throttle valve in opposition to an opening force imparted thereto by a governor spring 23. One end of this spring is connected to the arm 19 and its other end is attached to an adjustable anchor (not shown) which may be a speed selecting lever either directly or remotely adjusted.

Although no functional cooperation exists between the governor and the magneto of the engine, indicated generally by the numeral 24, the pivot pin 21 provides one of two screws by which the stator of the magneto is mounted on the engine. For this purpose, the lower end portion of the pin 21, which is of reduced diameter, passes through a hole in the adjacent leg 25 of the magneto core and is threaded into a tapped hole in the engine cylinder casting.

All of the structure described thus far is conventional. The novelty of this invention resides in the provision of actuating means to override the governor spring and effect adjustment of the throttle valve to an idling position whenever centrifugally responsive means releases the same. The structure by which this objective is achieved consists of an arm 27 pivotally mounted on the pivot pin 21, a strong wire spring 28 urging the arm in a clockwise direction of rotation about the pivot pin (as viewed in the drawings), a latch 29 to restrain the arm against spring produced rotation, and a trigger 30 to trip the latch when the trigger is moved by collision therewith of a centrifugally responsive actuator 31 mounted in the flywheel 13.

The spring 28 has its medial portion wrapped around one of the retaining pins 35 by which the laminations of the magneto core are held together, and has one end 34 thereof bearing against another of said retainer pins and its other end 32 hooked over one edge 33 of the arm. When the arm 27 is released for spring produced motion, a finger 36 projecting from the arm collides with the arm 19 that is linked to the throttle valve and thereby effects movement of the throttle valve to an idling position of adjustment.

The latch 29 by which the arm 27 is restrained against spring produced motion, and the trigger 30 together constitute a medially pivoted lever mounted to rock about a pivot pin 37 fixed to and projecting upwardly from a bracket 38 that is seated on the adjacent pole piece 25. This bracket, as shown in FIG. 4, is L-shaped, and embraces the adjacent portion of the pole piece. It has a downwardly projecting short leg 39 bearing against the side of the pole piece and a longer leg 40 seated on the top face of the pole piece. The bracket is held in place by being clamped between the shoulder at the upper end of the reduced diameter lower end portion of the pivot pin 21 and the top face of the pole piece when the reduced diameter threaded lower end portion of the pivot pin is screwed into a tapped hole in the adjacent portion of the engine crankcase. An intermediate diameter portion of the pin, the axial dimension of which is slightly greater than the thickness of the arm 27, freely pivotally mounts the arm, and a hexagonal head 41 at the top of the pin confines the hub 20 of the air vane against upwardly displacement.

A relatively light wire spring 42 yieldingly holds the latch engaged with a keeper finger 43 projecting from the arm 27. The medial portion of this spring is wrapped around the pivot pin 37 and one of its opposite ends bears against the back edge of the hook-shaped latch 29, while its other end bears against the adjacent edge of the bracket 38. The latch thus holds the arm 27 against throttle closing motion until the flywheel carried actuator 31 collides with the trigger and rocks it in a counterclockwise direction. When this occurs, not only is the latch disengaged, but also the mutually facing edged 44 and 45 on the arm 27 and on the latch slide along one another and, by virtue of their shape, hold the trigger 30 against being returned by the spring 42 to a position in the path of the centrifugally projected actuator 31. Hence, during the interval engine speed is reduced to the point at which the centrifugally responsive actuator is retracted, there will be no collision between it and the trigger.

After the mechanism has been tripped and the engine speed reduced to idle, it can be manually reset in any suitable manner, as by simply rotating the arm 27 to its latched position, but if the condition that caused the engine speed to exceed the saft limit persists, the mechanism will be tripped again and again until the operator realizes that it is time to clear the debris from the blower housing.

Figure 2:
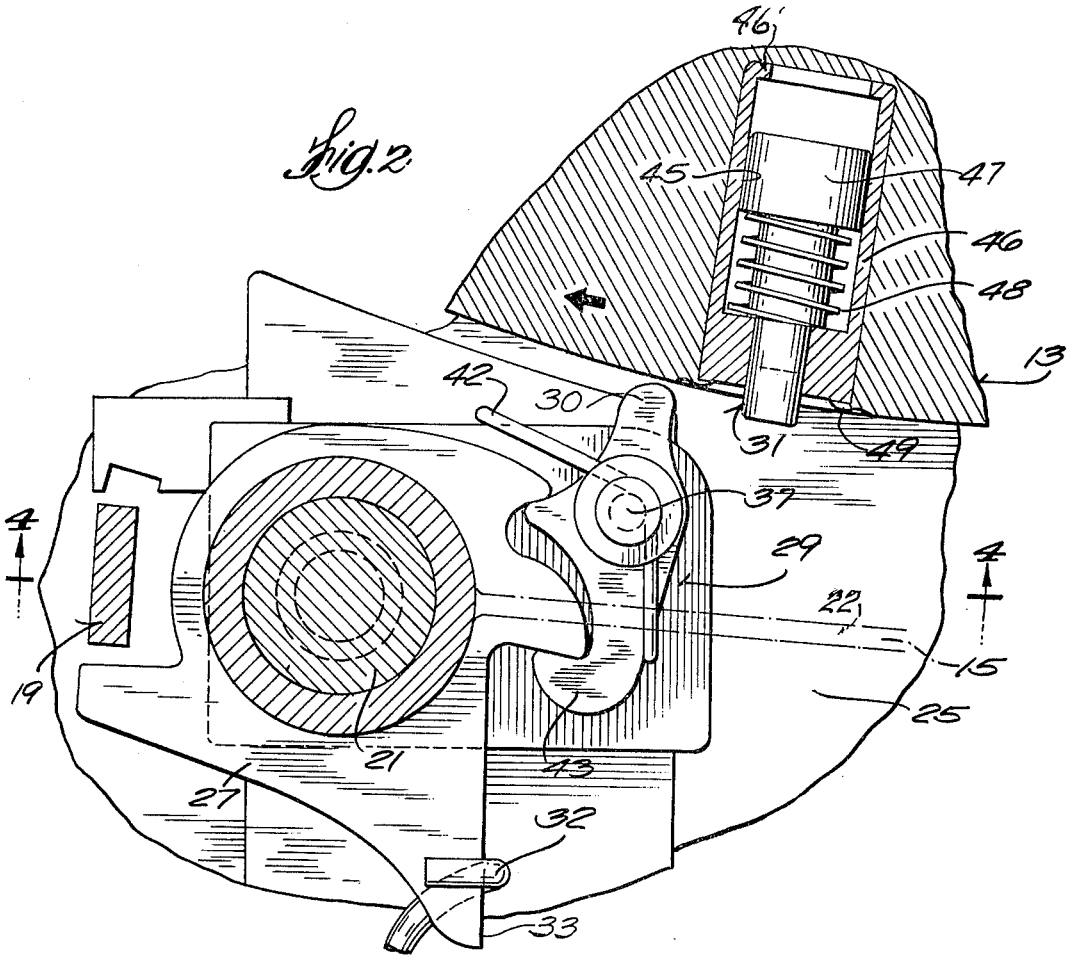
FIG. 2 is a fragmentary detail view in horizontal section, through FIG. 1 on the plane of the line 2—2, showing the overspeed preventing mechanism in its cocked potentially operative condition about to be tripped.
Figure 3:
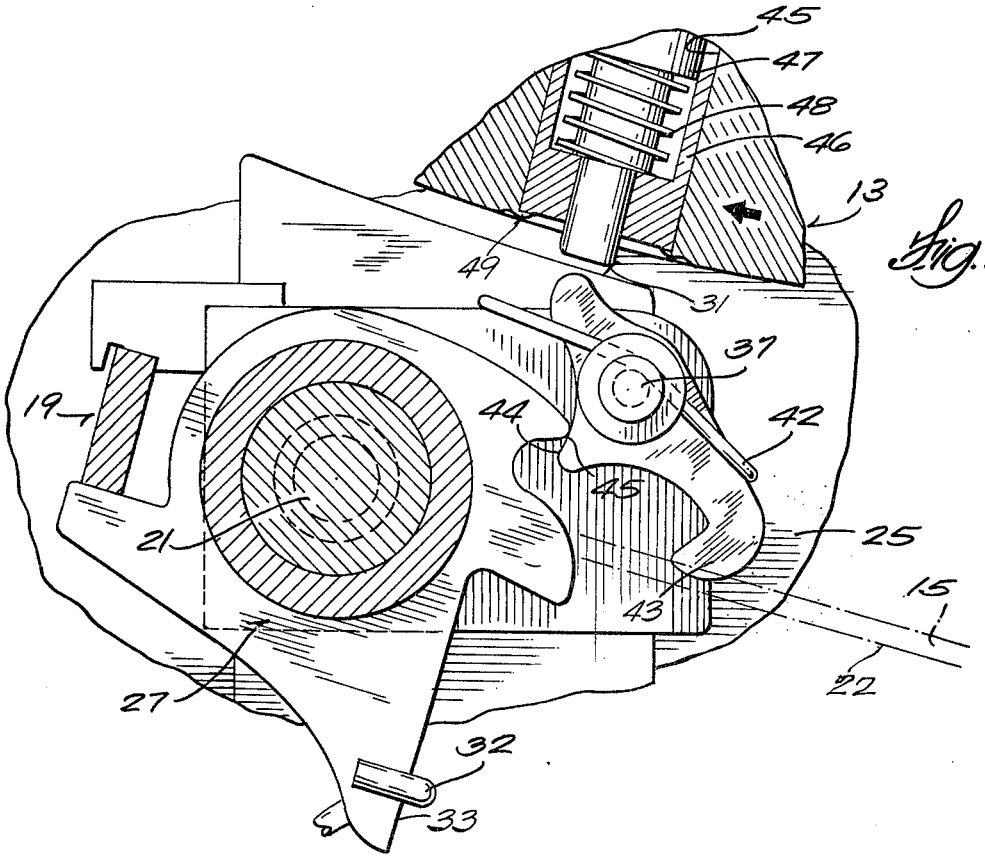
FIG. 3 illustrates the mechanism shown in FIG. 2, but in its tripped condition, with the air vane—shown in light broken lines—in the position to which it is moved by the mechanism to effect reduction in engine speed, and from which position the air vane can be manually moved to restore the mechanism to its cocked condition.

The centrifugally responsive actuator can take any desired form, but that illustrated in FIGS. 2 and 3 has been found to be entirely satisfactory. As there shown, the actuator comprises a capsule set into a hole 45 drilled radially into the periphery of the flywheel and held there by peening over the edge of the hole, as at 49. The capsule consists of a cylindrical shell 46 and a plunger 47 slidably received in the shell. The plunger has large, small and intermediate diameter portions. The small diameter portion of the plunger forms the actuator 31 and projects from the mouth of the bore of the shell when centrifugal force acting on the plunger overcomes the force of a coiled spring 48 by which the plunger is yieldingly held in its retracted position. This spring encircles the intermediate diameter portion of the plunger and is confined between shoulders formed by the junctions of different diameter portions of the bore and the plunger. A turned-in lip 46' at the mouth of the large diameter portion of the bore in the shell holds the plunger and spring assembled with the shell.

The manner in which the invention achieves its function is no doubt obvious from the foregoing description, so that no need exists for a detailed recapitulation of its operation. However, for the sake of emphasis, it is again pointed out that in effecting reduction in speed of the engine by bringing its throttle valve to an idling position—as is the case in the preferred embodiment of the invention—and having that occur each time the mechanism is reset, the advantage is achieved of preventing overheating of the engine and alerting the operator to the fact that the blower housing or shroud has become clogged.

It is, however, also possible to use the invention to actually stop the engine, i.e., to reduce its speed to zero, whenever the centrifugally responsive actuator trips the trigger. For this purpose, the primary coil of the magneto is grounded by the engagement of a projection 50 on the arm 27 with a blade 51 of an ignition grounding switch 26, as shown in FIG. 5.

As indicated hereinbefore, resetting of the mechanism after it has been tripped is effected by simply rotating the arm 27 to its latched position; but direct access to this arm usually is not convenient. By contrast, the arm 19 that projects from the hub 20 of the air vane is readily accessible and, since that arm is engageable with the finger 36 on the arm 27, resetting motion can be imparted to the arm 27 by moving the arm 19 in the direction to open the throttle. Since the arm 19 is connected by the link 16 with the throttle valve, the defined open position of the throttle valve determines the extent the arm 19 can be moved in the direction to reset the mechanism. Ordinarily, that permitted motion of the arm 19 is sufficient to effect re-engagement of the finger 43 on the arm 27 with the latch 29. But there are times when the positional relationship between the axis of the pivot pin 37 about which the latch rotates, and the range of motion of the air vane is such that re-engagement of the latch cannot be accomplished by motion imparted to the arm 19 of the air vane.

That unfortunate condition results from the need for establishing a predetermined spacial relationship between the core of the magneto and the orbit of the magnets of the magneto which is embedded in the flywheel. It is for this reason that the stator of the magneto is mounted directly on the engine cylinder-crankcase casting 55—see FIG. 6.

Figure 6:
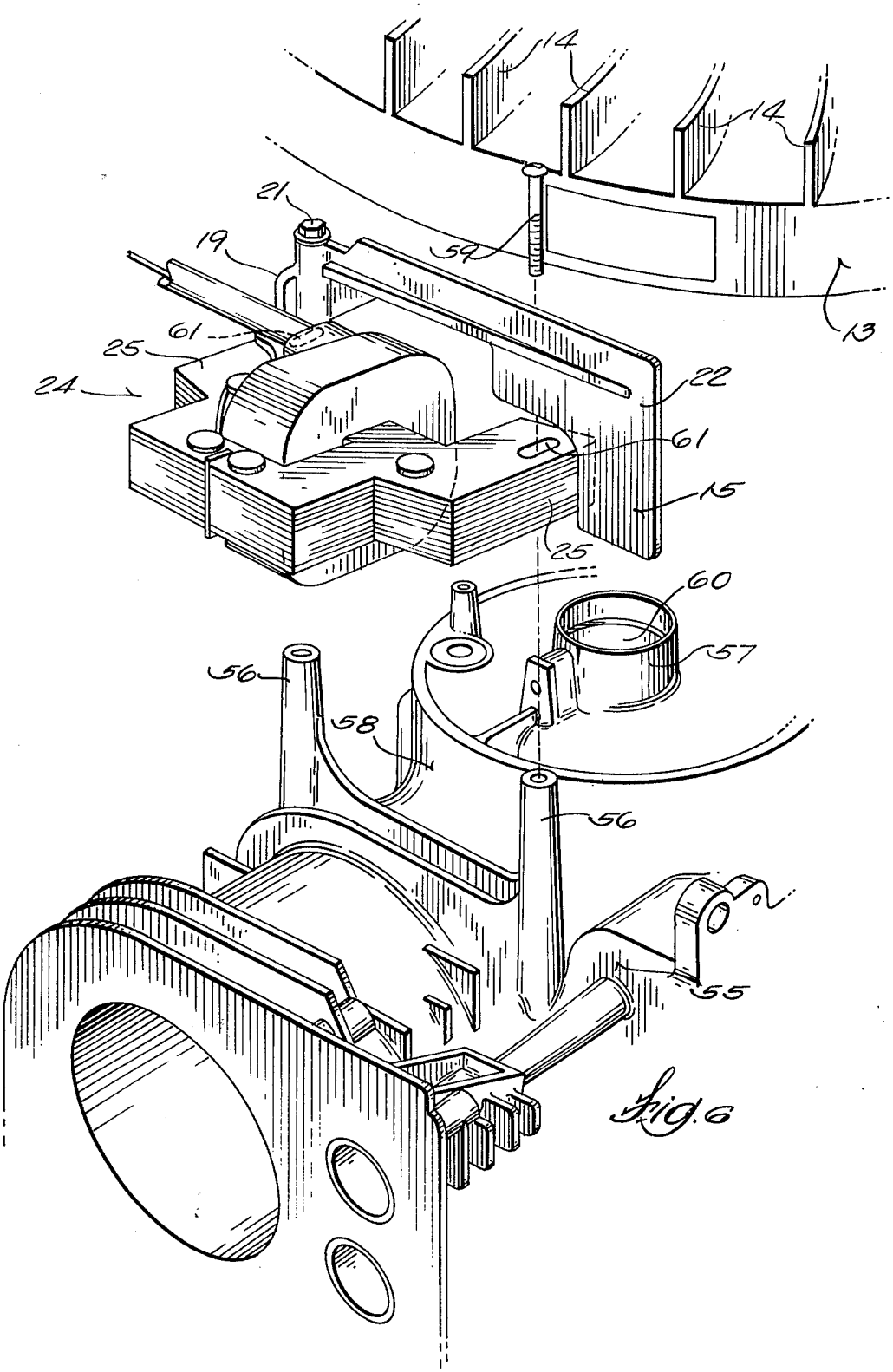
FIG. 6 is an exploded perspective view of the magneto stator and that part of the cylinder-crankcase casting upon which it its mounted upon assembly of these parts.

As shown in FIG. 6, the casting 55 has two posts 56 projecting from the side of the cylinder. These posts are equispaced from the axis of a hub 57 on the adjacent side of the crankcase portion 58 of the casting and have tapped holes. The legs of the magneto core are clamped to the ends of the posts by a screw 59 that passes through a hole in one of the legs and is screwed into the tapped hole in one post and by the pin 21—the lower threaded end portion of which passes through a hole in the other leg of the core and is screwed into the tapped hole in the other post.

Although the casting 55 is die-cast, there is no assurance that the distance between the axes of the tapped holes in the posts 56 and the axis of the crankshaft bearing 60 bored into the hub 57 will always be exactly the same; but the end faces of the legs of the magneto coil always must be spaced the same distance from the periphery of the flywheel. To assure this latter relationship, the holes 61 in the legs of the magneto core through which the lower end portion of the pin 21 and the screw 59 pass are elongated as shown in FIG. 6. This enables the magneto core to be shifted towards and from the flywheel periphery.

In making that adjustment, a shim is placed between the flywheel periphery and the pole faces of the magneto core and then—with the core advanced towards the flywheel to bring the pole faces against the shim—the pin 21 and the screw 59 are tightened. Since there is no assurance that the distance between the axis of the crankshaft bearing and the axes of the tapped holes in both posts 56 will be exactly the same, there are times when the magneto core must be rocked about the axis of the pin 21 or the screw 59 in adjusting the core to the flywheel. If that occurs, the angular travel of the arm 19, in consequence of manual inward deflection of the air vane to effect re-engagement of the latch, may not be far enough to rotate the arm 27 to a position at which the latch 29 snaps over the keeper finger 43.

To overcome that problem, a clearance adjusting member 65 is slidably mounted on the arm 19.

By moving this clearance adjusting member upwardly along the arm 19, an inclined cam surface 66 on one edge thereof can be brought to a location at which the clearance between the finger and the cam surface is sufficiently slight to assure latch re-engagement within the range of motion that can be imparted to the arm 19 by inward deflection of the air vane. Adjustment of the member 65 is effected with the mechanism in its securely latched condition, and simply involves sliding the member 65 upwardly on the arm 19 until its cam surface contacts the finger 36.

Another problem that was encountered at times resulted from the inevitable variations in the position of the flywheel on the crankshaft. Even a relatively slight deviation in the level of the flywheel would at times be enough to keep the centrifugally responsive actuator 31 from colliding with the trigger 30. To overcome that problem, the trigger has been provided with an upturnd end portion 30', as shown in FIG. 9. With this addition, collision of the actuator with the trigger of the latch is assured throughout a relatively wide range of flywheel elevation.

FIG. 10 illustrates a modified form of centrifugally responsive actuator. In this case, the actuator comprises a weighted lever 67 pivoted to the flywheel between a pair of adjacent blower vanes 14. A spring 68 holds the lever retracted until centrifugal force overcomes the spring, whereupon the actuator lever swings to its operative position.

Those skilled in the art will appreciate that the invention can be embodied in forms other than as herein disclosed for purposes of illustration.

The invention is defined by the following claims:

1. In an engine equipped with a governor of the type wherein a governor spring operatively connected with the engine throttle valve, imparts an opening force thereto in opposition to a closing force applied by air pressure produced by an engine driven fan acting on pressure responsive means also operatively connected with the throttle valvel, so that the governed speed of the engine is that at which said opposing forces balance, the improvement by which overspeeding of the engine is precluded, which improvement comprises:

A. normally inactive engine speed reducing means;

B. a centrifugally responsive actuator on a rotating part of the engine to travel in a defined circular orbit as long as the speed of the engine does not exceed a predetermined rate, but projectable by centrifugal force beyond said orbit when engine speed exceeds said predetemined rate; and C. activating means including a trigger positioned to be moved by collision therewith of said centrifugally responsive actuator when the latter is centrifugally projected, and operatively connected with said engine speed reducing means to effect activation of the same when said trigger is thus moved.

2. The invention defined in claim 1, wherein said normally inactive engine speed reducing means comprises:

1. a member movably mounted on a stationary part of the engine and operable upon motion thereof in one direction to effect reduction in engine speed, and 2. a spring acting upon said member and biasing it in said direction, and wherein said activating means includes latch means controlled by said trigger to restrain said member against spring produced motion until the actuator collides with and moves the trigger.

3. The invention defined by claim 2, further characterized by:

means yieldingly urging the trigger to a position in the path of the centrifugally projected actuator, and means operable upon latch releasing movement of said trigger by said centrifugally responsive actuator and the consequent release of the latch means, to restrain said trigger from returning to said position.

4. The invention defined by claim 2, wherein said movably mounted member is operatively connected with the throttle valve of the engine to move the same to an idling position upon release of said latch means.

5. The invention defined by claim 2, further characterized by an ignition grounding switch, and means whereby motion of said movable member upon release of said latch means closes said switch to thereby reduce the engine speed to zero.

6. The invention defined by claim 1, wherein said pressure responsive means comprises a pivoted air vane having a defined range of swinging motion, wherein said activating means includes a pivoted member yieldingly biased in one direction, a latch to releaseably hold said pivoted member against movement in said direction as long as the latch is engaged, said latch being disengaged by collision of the centrifugally responsive actuator with the trigger, wherein the connection between said activating means and the engine speed reducing means comprises an arm on the air vane and a finger on said pivoted member engageable with said arm upon triggered disengagement of the latch to move the air vane in the direction to apply closing force on the throttle valve, and whereby manual movement of the air vane in the opposite direction acting through engagement of said arm with said finger resets the latch, provided no excessive clearance exists between the arm and said finger when the latch is disengaged, and means for adjusting said clearance.

7. The invention defined by claim 6, wherein said clearance adjusting means comprises a member slidable along said arm and having an inclined cam surface to engage said finger.

8. The invention defined by claim 1, wherein the engine has a flywheel, and wherein said centrifugally responsive actuator is mounted on the flywheel.

9. The invention defined by claim 8, wherein said centrifugally responsive actuator comprises a plunger slidably received in a bore in the peripheral portion of the flywheel and radial thereto, the plunger having a reduced diameter outer end portion that is projectable beyond the periphery of the flywheel in response to centrifugal force acting on the plunger, and a spring reacting between shoulders on the plunger and on the wall of the bore, to yieldingly retain the plunger in a retracted position in which its reduced diameter outer end portion does not project beyond the periphery of the flywheel.

10. The invention defined by claim 8, wherein the portion of said trigger with which the centrifugally responsive actuator collides is an edge substantially parallel to the axis of the flywheel and sufficiently long to assure its being in the path of the actuator despite variations in the plane of the orbit of the actuator with respect to the location of the trigger.

11. The invention defined by claim 8, wherein said centrifugally responsive actuator comprises a lever pivoted to the flywheel to swing about an axis parallel to the flywheel axis, said lever being weighted to swing outwardly beyond the periphery of the flywheel in response to centrifugal force, and a spring reacting between said pivoted lever and the flywheel to yieldingly hold the lever in a retracted position.

12. In an engine equipped with a governor of the type wherein a governor spring operatively connected with the engine throttle valve imparts an opening force thereto in opposition to a closing force applied by air pressure produced by an engine driven fan acting on pressure responsive means also operatively connected with the throttle valve, so that the governed speed of the engine is that at which said opposing forces balance, the improvement by which overspeeding of the engine is precluded, and which improvement comprises:

A. biasing means connectable with the throttle valve of the engine and operable to apply a closing force thereon that exceeds the maximum opening force the governor spring can exert;

B. latch means to restrain said biasing means;

C. a trigger to trip the latch means; and

D. centrifugally responsive means on a rotating part of the engine to impart latch tripping movement to the trigger and thereby enable said biasing means to move the throttle valve to an idling position in the event the speed of the engine exceeds a predetermined rate.

13. The invention defined by claim 12, wherein said centrifugally responsive means comprises an actuator traveling in a defined circular orbit as long as the speed of the engine is below said predetermined rate, but projectable therebeyond by centrifugal force, and further characterized by means biasing the trigger to a position in the path of said actuator when the latter is projected beyond said orbit, and means operable upon tripping of the latch means for holding said trigger out of the path of the centrifugally projected actuator.

14. The invention defined by claim 12, wherein said pressure responsive means is a freely pivoted air vane, and the means operatively connecting the same with the throttle valve includes a motion transmitting arm fixed with respect to the air vane and connected with the throttle valve so that any motion of the air vane and its arm is accompanied by adjustments of the throttle valve, and wherein the force of said biasing means is applied to the throttle valve through a pivoted lever positioned to collide with said motion transmitting arm and move the same in the direction to bring the throttle valve to said idling position.

15. The invention defined by claim 14, wherein said biasing means is a spring reacting between said pivoted lever and a stationary part of the engine.

16. The invention defined by claim 12, wherein 1. said pressure responsive means includes a motion transmitting member connected with the throttle valve to partake of any motion of the latter and through which adjusting motion can be imparted to the throttle valve independently of any response of said pressure responsive means to air pressure acting thereon,
2. wherein said biasing means comprises an arm mounted to rotate about a fixed axis and having a finger projecting therefrom to swing in an arc and, upon motion in one direction along said arc, collide with said motion transmitting member and impart throttle closing motion thereto, and a spring reacting between said arm and a fixed part of the engine to impart torque to the arm in the direction to move said finger towards collision with said motion transmitting member, and
3. wherein said latch means comprises
   a. a hook mounted to rock about a fixed axis parallel to the axis about which said arm rotates, and a ledge on said arm with which said hook engages to hold the arm in a cocked potentially active position against the force of said spring,
   b. a second spring biasing said hook towards engagement with said arm, and
   c. a trigger on said hook occupying a position when the hook is engaged with said ledge that places the trigger in the path of the actuator.

17. The invention defined by claim 16, further characterized by interengageable surfaces on said arm and said hook, shaped to hold the trigger out of the path of the projected centrifugally responsive actuator as long as the arm is in the position to which the spring acting thereon moves it in consequence of triggered release of said arm.

18. In an engine equipped with a governor of the type wherein a governor spring operatively connected with the engine throttle valve imparts an opening force thereto in opposition to a closing force applied by air pressure produced by an engine driven fan acting on pressure responsive means also operatively connected with the throtle valve, so that the governed speed of the engine is that at which said opposing forces balance, the improvement by which overspeeding of the engine is precluded, which improvement comprises:

A. an ignition grounding switch with coacting contacts, one of which is movable along a defined path to and from engagement with the other;

B. biasing means acting on the movable switch contact and tending to move the same into ignition grounding engagement with the other contact;

C. latch means restraining said biasing means; and

D. centrifugally responsive means on a rotating part of the engine operable to trip said latch means and thereby release said movable switch contact for movement into engagement with the other switch contact in the event the speed of the engine exceeds a predetermined rate.

19. In an engine equipped with a throttle valve, a flywheel and an air vane type governor wherein a governor spring operatively connected with the engine throttle valve imparts an opening force to the throttle valve in opposition to a closing force applied thereto by the response of a movable air vane to air pressure produced by an engine driven fan, so that the governed speed of the engine is that at which said opposing forces balance, the improvement by which the engine throttle valve is moved to an engine idling position in the event the governor fails to function, which improvement comprises:

A. a centrifugally responsive actuator movably mounted on the engine flywheel for movement between a retracted position and a projected position;

B. means reacting between said actuator and the flywheel to yieldingly maintain the actuator in its retracted position at all engine speeds below a predetermined magnitude while allowing the actuator to move to its projected position when engine speed exceeds said predetermined magnitude;

C. normally restrained force producing means operatively connected with the engine throttle valve effective upon being freed of its restraint to effect movement of the throttle valve to its idling position; and D. means for releasably restraining said force producing means, including a trigger positioned to be actuated by collision therewith of said centrifugally responsive means when the latter is in its projected position, whereby upon such collision said force producing means is released and effects movement of the throttle valve to its idling position.

* * * * *